United States Patent [19]

Caudill

[11] Patent Number: 4,817,639

[45] Date of Patent: Apr. 4, 1989

[54] TOBACCO LEAF CLEANING DEVICE

[76] Inventor: Charles R. Caudill, P.O. Box 729 - Space 1062, Apache Junction, Ariz. 85217

[21] Appl. No.: 73,271

[22] Filed: Jul. 14, 1987

[51] Int. Cl.[4] ..... A24B 1/04

[52] U.S. Cl. ..... 131/325

[58] Field of Search ..... 131/325

[56] References Cited

U.S. PATENT DOCUMENTS

| | | |
|---|---|---|
| 973,228 | 10/1910 | Spierer . |
| 1,831,953 | 11/1931 | Fonseca . |
| 2,343,837 | 3/1944 | Wheeler . |
| 2,847,698 | 8/1958 | Ritterson . |
| 2,885,069 | 5/1959 | Bowen . |
| 2,942,607 | 6/1960 | Skinner . |
| 3,983,888 | 10/1976 | Edwards . |
| 4,428,090 | 1/1984 | Coggin et al. . |
| 4,489,823 | 12/1984 | Gordon . |
| 4,533,036 | 8/1985 | Gordon . |

*Primary Examiner*—V Millin

*Attorney, Agent, or Firm*—LaValle D. Ptak

[57] ABSTRACT

A tobacco leaf cleaning device for removing foreign particles, such as lint and string, from tobacco leaves as the tobacco moves from one point to another on a conveyor in a processing plant, is in the form of a flexible canvas sheet suspended from a rod parallel to the conveyor and extending downwardly into engagement with the leaves on the conveyor. The lower end of the sheet is slit into a plurality of fingers and the surface which engages the moving leaves has male Velcro fastener material attached to it for engaging and removing the lint and string as the leaves pass beneath the canvas sheet.

20 Claims, 1 Drawing Sheet

TOBACCO LEAF CLEANING DEVICE

BACKGROUND

Before various articles can be made from tobacco leaves, it is necessary to clean the leaves to remove dust and other contaminants from them. Prior to final processing tobacco leaves are subjected to wide variety of contamination from insects, dust, sand, and the like. In addition, the leaves of flue-cured tobacco are tied together and looped onto tobacco sticks with cotton string, which supports the leaves in the curing barns during the curing process. Frequently these cotton strings or portions of the strings become mixed in with the leaves during the processing operations.

Tobacco scraps and some tobacco leaves also are packed in burlap sacks for delivery from the growers to the processing plants; and when tobacco scraps and leaves are emptied from such burlap bags, burlap fibers become mixed in with the leaves and scraps of tobacco. A variety of other foreign matter also frequently is present.

Because of the presence of foreign matter in the tobacco leaves and tobacco scraps, the tobacco in a processing plant is placed on tables and moved on conveyors past operators who manually pick out the largest and most obvious contaminants, such as string segments, feathers, straw, and the like. It is difficult, however, if not impossible for such operating personnel to remove fine particles such as burlap bag fibers and cotton string fibers and similar contaminants from the tobacco; so that these smaller contaminants are overlooked.

To remove contaminants such as dust and insect eggs from the tobacco, tobacco cleaning machines have been developed using rotating brushes for engaging the tobacco leaves as they moves beneath the brushes on a conveyor belt. Two such tobacco cleaning machines are disclosed in the Patents to Spierer U.S. Pat. No. 973,228 and Fonseca U.S. Pat. No. 1,831,953. The devices of both of these patents are similar to one another; and both of them employ rotating brushes to engage the surfaces of the leaves to remove dust, insects, larva, eggs and other surface impurities from the tobacco. Rotating brush cleaners in conjunction with shakers, air blowers and other apparatus continue to be used to prepare tobacco leaves for processing.

A rotating brush machine for cleaning tobacco scrap to separate the tobacco scrap from dirt and larger contaminants is disclosed in the Patent to Skinner U.S. Pat. No. 2,942,607. The machine of the Skinner Patent employs a plurality of rotating brushes for moving the tobacco from a hopper up a series of inclined planes to separate the desired tobacco scraps from different sizes of contaminants in various stages of operation.

It has been found, however, that even when rotating brush cleaning machines are used to remove foreign matter from tobacco leaves, as the leaves move from conveyor to conveyor throughout the processing plant, the cleaned tobacco still includes fine particles of lint, string and the like, which ultimately become incorporated into the products made from the tobacco.

Accordingly, it is desirable to provide a device which can be used to more effectivly remove particles of lint, burlap bag fibers, string and other contaminants from tobacco leaves prior to the processing of such leaves into various products. It further is desirable for such a device to be efficient in operation and inexpensive to manufacture, install and operate.

SUMMARY OF THE INVENTION

It is an object of the invention to provide an improved tobacco cleaning device.

It is an additional object of this invention to provice an improved device for removing foreign particles from tobacco leaves.

It is another object of this invention to provide an automatic tobacco leaf cleaning device.

It is a further object of this invention to provide an improved tobacco leaf cleaning device which automatically removes lint and fine fibers from tobacco leaves as they are transported from place to place in a processing plant.

In accordance with a preferred embodiment of the invention, a tobacco leaf cleaning device is employed to remove foreign particles such as lint, burlap bag fibers, and string from tobacco leaves as the leaves are being processed. The device comprises a support located above moving tobacco leaves. A flat flexible sheet is attached to the support and is permitted to engage the leaves as they pass under the support to which the sheet is attached. The lower end of the sheet, which engages the tobacco leaves, has cleaning members on it for contacting the leaves as they move beneath the sheet. These cleaning members are constructed to engage and remove lint, burlap bag fibers, string and similar foreign particles from the leaves as the tobacco is moved beneath the sheet.

DETAILED DESCRIPTION

Figure 1:
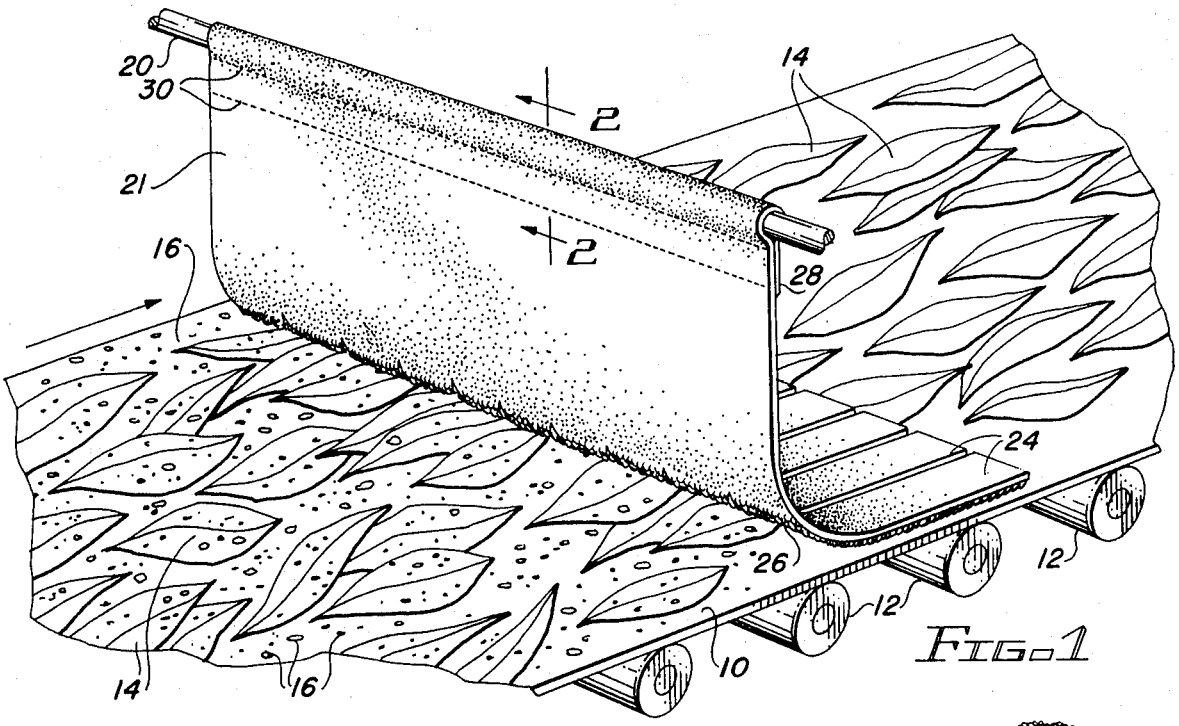
FIG. 1 is a perspective view of a preferred embodiment of the invention.

Reference now should be made to the drawing in which the same reference numbers are used throughout the different figures to designate the same components.

In FIG. 1, a conveyor belt 10 of the type typically used in a tobacco processing factory is illustrated. The conveyor 10 moves in the direction of the arrow over rollers 12 in a conventional manner. Various conveyor belts of this type are used in the factory to move tobacco leaves 14 from one point to another during the processing operation. Leaves are transfered from one conveyor to another to cause them to turn over; so that they may be cleaned on both sides; and various cleaning operations of the typed described above are employed to remove foreign particles and other foreign matter from the leaves.

Even after the conventional cleaning operations have been effected, a number of particles 16 comprising burlap fibers, string, lint and the like, still remain interspersed among the leaves 14 moving on the conveyor 10. To remove these particles from the leaves 14, the cleaning device illustrated in FIG. 1 is provided. As shown in FIG. 1, a rod 20 is supported on the conveyor machinery (in a manner not illustrated) to extend parallel to the surface of the conveyor 10 and transversely across that surface. A sheet of canvas 21 has a loop formed in its upper end to pass over the rod 20 and is held in place by parallel rows of stitching 30, as illustrated most clearly in FIGS. 1 and 2. The sheet 21 has a length which is greater than the distance of the rod 20 from the surface of the conveyor 10, so that the sheet rests on top of or touches the conveyor 10 and leaves 14. The sheet 21 is pushed toward the right, as viewed in FIG. 1, under the action of the movement of the conveyor 10 to assume the configuration illustrated in FIG. 1. The lower end of the sheet 21, which typically is made of canvas or other suitable flexible material, is divided into several parallel flexible strips 24 by cutting or slitting the lower end of the sheet 21 from the bottom upwardly to a distance of approximately 12 inches from the bottom (for a sheet suspended over the conveyor 10 at a distance of 12 to 18 inches, for example). This permits the individual strips 24 to independently conform to variations in thickness of the leaves 14 and other materials passing under the end of the sheet 21 in the manner illustrated.

On the front surface of the sheet 21, that is the surface which faces the incoming leaves conveyed on the conveyor belt 10, strips of the hook or male portion 26 of a hook and loop fastener material, such as VELCRO® (a trademark of Velcro USA, Inc.) is attached. This is shown most clearly in FIG. 3. As is well known, the hook portion of VELCRO fastener material is in the form of tiny, closely packed, outwardly extending, hook members. The hook members of the portions 26 engage lint and fibers and hold them firmly in place on the surfaces of the portions 26, to remove them from the leaves 14 and the conveyor belt 10 as it moves toward the right as illustrated in FIG. 1. Additional cleaning devices similar to the ones shown in FIG. 1, may be used on other conveyors after the leaves 14 have been turned or dumped onto a different conveyor to complete the final cleaning stages of the tobacco leaves 14.

Whenever the surfaces of the portions 26 become sufficiently full of particles 16, the entire sheet 21 may be replaced by removing the rod 20 and placing a new sheet 21 on the rod to assume the configuration shown in FIG. 1. Alternatively, the VELCRO portions 26 on the strips 24 may be removably attached; so that the individual portions 26 may be replaced without removing the flexible sheet 21 from the machine. This latter approach, however, is more time consuming than replacing the entire sheet since, in the manufacturer of the sheet 21, the VELCRO portions 26 typically are secured to the front of the sheet 21 (or the entire sheet is made up of such material) prior to the formation of the strips 24 by the slits illustrated in FIG. 3. If the replacement of the surfaces portions 26 is effected on a sheet 21, the lower end of which has already been cut to form the individual slits 24, individual narrow strips 26 of the VELCRO material must be applied. Since a typical width of the sheet 21 is forty-eight inches and the strips 24 are from two to four inches in width, it is quite time consuming to apply individual strips 26 of velcro hooks to the front surfaces of the strips 24 after they have been formed. Consequently, in most cases, the entire sheet 21 is removed and replaced with a new one when the surfaces 26 become sufficiently full of lint, fibers, strings, and other waste material.

Figure 2:
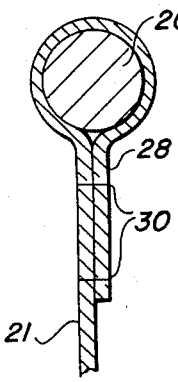
FIG. 2 is a cross-section taken along the line 2—2 of FIG. 1.
Figure 3:
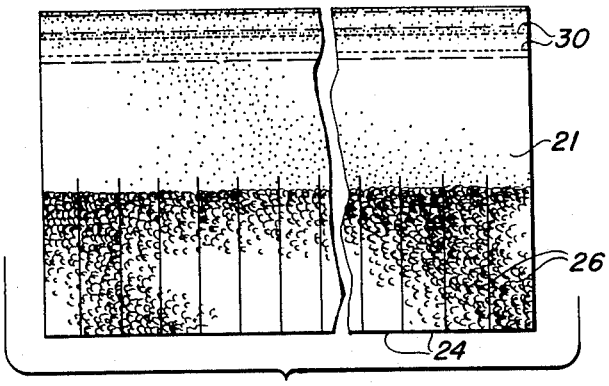
FIG. 3 is a front view of the embodiment shown in FIG. 1.
Figure 5:
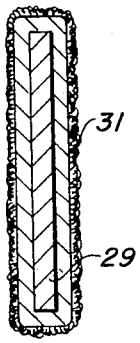
FIGS. 4 and 5 illustrate details of an alternative of a portion of the embodiment shown in FIG. 1.
Figure 4:
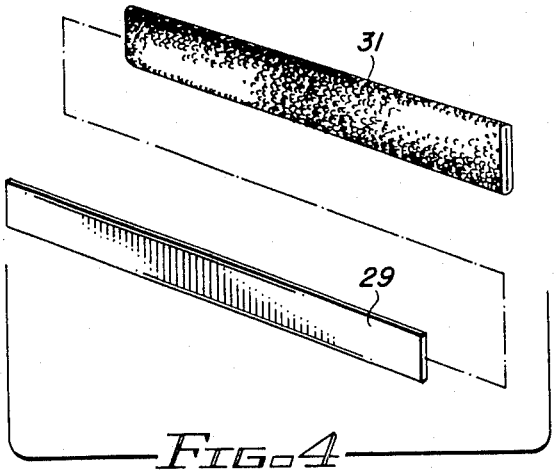

FIGS. 4 and 5 illustrate another technique which may be used in place of the one illustrated in FIGS. 1 through 3 for supporting the sheet 21 over the conveyor belt 10. In place of the rod 20, a metal bar 29 covered with a sleeve 31 of the loop portion of a VELCRO fastener is provided. The sleeve 31 is placed over the plate 29 which is supported over the conveyor belt 10 in any suitable manner (not shown) to assume the position of the rod 20 illustrated in FIG. 1. The upper end of the sheet 21 then has a strip of hook or male VELCRO fastener material attached transversely across it, so that the sheet 21 is pressed in place against the material 31 to suspend the sheet over the conveyor 10 in the same manner illustrated in FIG. 1. When a sheet 21 is to be replaced with a new sheet, it simply is necessary to peel the sheet 21 off of the material 31 and replace it with a new sheet.

Figure 6:
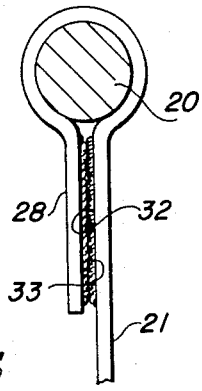
FIGS. 6 and 7 illustrate another variation of the embodiment of FIG. 1.
Figure 7:
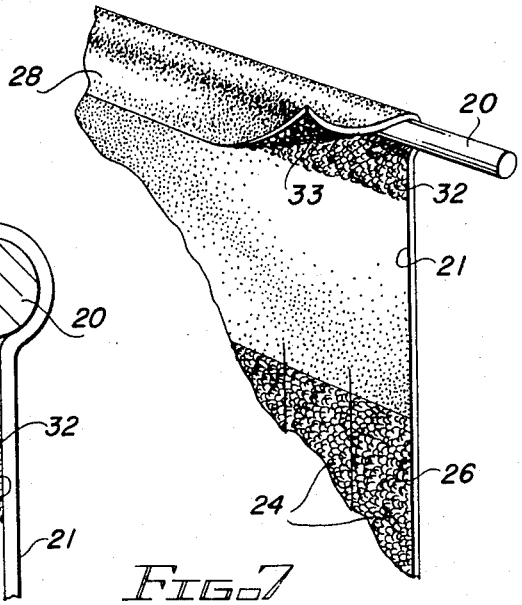

FIGS. 6 and 7 illustrate another technique which may be used for fastening the sheet 21 to the rod 20 of FIG. 1. As illustrated in FIGS. 6 and 7, the upper edge of the sheet 21 has a transverse hook or male VELCRO strip 33 attached to it. Spaced a short distance downwardly from the strip 33, is a parallel transverse strip of loop VELCRO material 32. The distance between the two strips is selected to enable the upper edge 28 of the sheet 21 to be folded over the rod 20, so that the portions 32 and 33 may be pressed together to secure the sheet 21 in place on the rod 20. It is readily apparent that this technique permits a simple, fast and effective way of removing and replacing sheets 21 as needed in the operation of the device.

The foregoing description of the different embodiments of the invention is to be considered to be illustrative and not as limiting. Various changes and modifications will occur to those skilled in the art, without departing from the true scope of the invention. For example, the tobacco leaf cleaning device, which is discribed and illustrated, is a simple and effective cleaning device for removing foreign particles from tobacco leaves in an inexpensive manner.

I claim:

1. A tobacco leaf cleaning device for removing foreign particles such as lint and string from tobacco leaves as the tobacco moves from one point to another on said cleaning device including in combination:

means for moving tobacco leaves;

support means located a predetermined distance above said means for moving tobacco leaves;

a flat flexible sheet member having a predetermined length greater than said predetermined distance, said sheet member having upper and lower ends;

means for attaching the upper end of said sheet member to said support means; and cleaning means on the lower end of said sheet member for contacting tobacco leaves as the leaves pass under said sheet member for removing lint and foreign particles from the leaves.

2. The combination according to claim 1 wherein said flat flexible sheet member has front and rear faces, the front face thereof located to contact the tobacco leaves as the leaves pass under said sheet member, with said cleaning means located on said front face on at least the portion of said front face which contacts the tobacco leaves.

3. The combination according to claim 2 wherein sheet member comprises a sheet of canvas.

4. The combination accordig to claim 3 wherein said cleaning means comprises a plurality of densely packed resilent hook members.

5. The combination according to claim 4 wherein said resilent members are made of the male portion of a Velcro fastener.

6. The combination according to claim 5 wherein said means for moving leaves comprises a conveyor, and wherein said support means extends transversely across the width of said conveyor on which the tobacco leaves are moved; and said flexible sheet member has a width which is at least as wide as the portion of said conveyor on which tobacco leaves are moved.

7. The combination according to claim 6 wherein a plurality of slits extend perpendicularly from the lower end of said sheet member to a position intermediate the upper end and lower ends thereof to form a plurality of leaf engaging fingers on said sheet.

8. The combination according to claim 7 wherein said cleaning means is attached to said fingers on at least the side which engages the leaves on the conveyor.

9. The combination according to claim 8 wherein said attaching means removably attaches the upper end of said sheet member to said support means.

10. The combination according to claim 9 wherein said attaching means comprises transverse parallel matching Velcro fastening strip members spaced apart from one another adjacent the upper end of said flexible sheet on the same side thereof; said support means comprises a rod mounted substantially parallel to the surface of the conveyor; and said sheet is attached to said rod by wrapping said sheet over said rod and engaging the mating velcro fastening strip members to one another beneath said rod.

11. The combination according to claim 1 wherein said means for moving leaves comprises a conveyor; and wherein said support means extends transversely across the width of said conveyor on which the tobacco leaves are moved; and said flexible sheet member has a width which is at least as wide as the portion of said conveyor on which tobacco leaves are moved.

12. The combination according to claim 11 wherein a plurality of slits extend perpendicularly from the lower end of said sheet member to a position intermediate the upper end and lower ends thereof to form a plurality of leaf engaging fingers on said sheet.

13. The combination according to claim 12 wherein said cleaning means is attached to said fingers on at least the side which engages the leaves on the conveyor.

14. The combination according to claim 1 wherein said attaching means removably attaches the upper end of said sheet member to said support means.

15. The combination according to claim 14 wherein said attaching means comprises transverse parallel matching Velcro fastening strip members spaced apart from one another adjacent the upper end of said flexible sheet on the same side thereof; said support means comprises a rod mounted substantially parallel to a surface on which the leaves move; and said sheet is attached to said rod by wrapping said sheet over said rod and engaging the mating velcro fastening strip members to one another beneath said rod.

16. The combination according to claim 1 wherein sheet member comprises a sheet of canvas.

17. The combination accordig to claim 1 wherein said cleaning means comprises a plurality of densely packed resilent hook members.

18. The combination according to claim 17 wherein said resilent members are made of the male portion of a Velcro fastener.

19. The combination according to claim 1 wherein a plurality of slits extend perpendicularly from the lower end of said sheet member to a position intermediate the upper end and lower ends thereof to form a plurality of leaf engaging fingers on said sheet.

20. The combination according to claim 19 wherein sheet member comprises a sheet of canvas.

* * * * *